US010030316B2

(12) United States Patent
Fujita et al.

(10) Patent No.: US 10,030,316 B2
(45) Date of Patent: Jul. 24, 2018

(54) PRODUCTION METHOD FOR STAINLESS STEEL CONTAINING MEMBER

(71) Applicant: ARAYA INDUSTRIAL CO., LTD., Osaka-shi, Osaka (JP)

(72) Inventors: Hiroshi Fujita, Osaka (JP); Yu Imada, Tokyo (JP)

(73) Assignee: ARAYA INDUSTRIAL CO., LTD., Osaka (JP)

( * ) Notice: Subject to any disclaimer, the term of this patent is extended or adjusted under 35 U.S.C. 154(b) by 0 days.

(21) Appl. No.: 15/141,128

(22) Filed: Apr. 28, 2016

(65) Prior Publication Data

US 2017/0022626 A1 Jan. 26, 2017

(30) Foreign Application Priority Data

Jul. 21, 2015 (JP) ..... 2015-143835

(51) Int. Cl.
*C25F 3/24* (2006.01)

(52) U.S. Cl.
CPC ..... *C25F 3/24* (2013.01)

(58) Field of Classification Search
CPC ..... C25F 3/16; C25F 3/24; C25F 3/14; B23H 2400/00
See application file for complete search history.

(56) References Cited

U.S. PATENT DOCUMENTS 2,115,005 A 4/1938 Blaut
3,331,760 A * 7/1967 Powell ..... C25F 3/02 204/222
5,681,448 A 10/1997 Uchiyama et al.
5,773,087 A 6/1998 Kashihara et al.
2004/0050715 A1* 3/2004 Zhu ..... B23H 3/08 205/676
2007/0209947 A1* 9/2007 Shrivastava ..... C25F 3/16 205/662
2011/0210011 A1* 9/2011 Ho ..... C25F 3/24 205/661

(Continued)

FOREIGN PATENT DOCUMENTS

CN 2364059 Y 2/2000
CN 104011266 A 8/2014
CN 204198894 U 3/2015

(Continued)

OTHER PUBLICATIONS

Office Action dated Sep. 1, 2015, issued in counterpart Japanese Patent Application No. 2015-143835, with English translation. (9 pages).
Jul. 2, 2010, "Electropolishing Stainless Steels." URL: http://www.worldstainless.org/Files/issf/non-image-files/PDF/Euro_Inox/Eleotropolishing_EN.pdf [pp. 3 and 6], [p. 5], and [p. 13].
Aug. 3, 2012, "Electropolishing for Hydraulics & Pneumatics." URL: http://www.ableelectropolishing.com/wp-content/uploads/2014/07/AbleElectropolishing-HydraulicsPneumatics-ForWeb.pdf [pp. 6 and 7], [p. 11].

(Continued)

*Primary Examiner* — Nicholas A Smith
(74) *Attorney, Agent, or Firm* — Westerman, Hattori, Daniels & Adrian, LLP

(57) ABSTRACT

There is provided a production method for a stainless steel containing member, including the steps of: blasting a surface of a hollow starting member having a long side direction and a short side direction, the surface being composed of stainless steel; and electropolishing the surface having been blasted, in the step of electropolishing, the starting member being immersed in an electropolishing solution with the long side direction of the starting member being inclined relative to a horizontal direction.

6 Claims, 4 Drawing Sheets

(56) References Cited

U.S. PATENT DOCUMENTS

| | | | | |
|---|---|---|---|---|
| 2011/0247943 | A1* | 10/2011 | Bialas | C25F 3/16 205/671 |
| 2013/0168256 | A1 | 7/2013 | Lackner et al. | |

FOREIGN PATENT DOCUMENTS

| | | | | | |
|---|---|---|---|---|---|
| GB | 557386 | A | * | 11/1943 | C25F 7/00 |
| JP | 05278160 | A | * | 10/1993 | |
| JP | H05-278160 | A | | 10/1993 | |
| JP | H08-181103 | A | | 7/1996 | |
| JP | 09085888 | A | * | 3/1997 | |
| JP | H09-85888 | A | | 3/1997 | |
| JP | H10-427 | A | | 1/1998 | |
| JP | 11-226606 | A | | 8/1999 | |
| JP | 2000-282300 | A | | 10/2000 | |
| JP | 2008-274386 | A | | 11/2008 | |
| JP | 2008274386 | A | * | 11/2008 | |
| JP | 2010-168655 | A | | 8/2010 | |
| KR | 2006088585 | A | * | 8/2006 | C25F 3/16 |

OTHER PUBLICATIONS

Office Action dated Sep. 23, 2016, issued in counterpart Taiwanese Patent Application No. 105112092, with English translation. (8 pages).

Aug. 3, 2012, "#125 Surface Adjustments—Electrolytic Polishing" URL: http://www.misumi-techcentral.com/tt/en/suface/2012/08/125-surface-adjustments---electrolytic-polishing.html [p. 1/2, Fig. 1].

Office Action dated Nov. 17, 2016, issued in counterpart Chinese Application No. 201610313431.2, with English translation. (8 pages).

Office Action dated Apr. 25, 2017, issued in counterpart Chinese Patent Application No. 201610313431.2, with English translation. (8 pages).

* cited by examiner

PRODUCTION METHOD FOR STAINLESS STEEL CONTAINING MEMBER

BACKGROUND OF THE INVENTION

Field of the Invention

The present invention relates to a production method for a stainless steel containing member, and the stainless steel containing member.

Description of the Background Art

Stainless steel is a material excellent in corrosion resistance (rust resistance) and heat resistance, and is used in a wide range of daily necessaries to industrial products and industrial facilities. Conventionally, in view of design and corrosion resistance, surfaces of stainless steel members used for various purposes are normally mirror-finished by polishing or the like.

However, in recent years, a demand arises with regard to a life in highly clean and hygienic environment, and accordingly, it is proposed to satin-finish a surface of stainless steel (provide surface unevenness) to provide a property with which fingerprints are less recognizable (this property is also referred to as "fingerprint concealing property" in the present specification) and to provide stain resistance, (for example, Japanese Patent Laying-Open No, 11-226606 and Japanese Patent Laying-Open No. 2010-168655).

SUMMARY OF THE INVENTION

The present invention has an object to provide: a production method for a stainless steel containing member, which is a member having surface unevenness composed of stainless steel and is excellent in in-plane uniformity of the uneven surface shape: and the stainless steel containing member obtained by the production method.

The present invention provides a production method for a stainless steel containing, member and the stainless steel containing member as described below.

[1] A production method for as stainless steel containing member including the steps of:

blasting a surface of a starting member having a long side direction and a short side direction, the surface being, composed of stainless steel; and electropolishing the surface having been blasted, in the step of electropolishing, the starting member being immersed in an electropolishing solution with the long side direction of the starting member being inclined relative to a horizontal direction.

[2] The production method according to [1], wherein in the step of electropolishing, the starting member is immersed in the electropolishing solution such that the long side direction of the starting member is substantially in parallel with a vertical direction.

[3] The production method according to [1] or [2], wherein in the step of electropolishing, the starting member is immersed in the electropolishing solution with an upper end of the starting member being fixed to a supporting member.

[4] The production method according to any one of [1] to [3], wherein in the step of electropolishing, an electrode adjustable in position in the electropolishing solution is immersed in the electropolishing solution.

[5] The production method according to any one of [1] to [4], further including the step of forming a coating layer on the surface having been electropolished after the step of electropolishing.

[6] The production method according to [5], wherein the coating layer contains a rust prevention agent.

[7] The production method according to any one of [1] to [6], wherein the starting member is hollow.

[8] A stainless steel containing member obtained by the production method recited in any one of [1] to [7].

According to the present invention, there can be provided a production method for a stainless steel containing member, which is a member having surface unevenness composed of stainless steel and is excellent in in-plane uniformity of the uneven surface shape, as well as the stainless steel containing member obtained by the production method and excellent in in-plane uniformity of the uneven surface shape.

According, to the present invention, there can be obtained a stainless steel containing member that is uniform in terms of properties such as fingerprint concealing property, corrosion resistance, and cleanability in a plane of the surface thereof. Moreover, according to the present invention, the design of the stainless steel containing member can be also improved by the matte feeling resulting from the surface unevenness.

It should be noted that the term "cleanability" in the present specification indicates how unlikely stain (inclusive of fine particles, virus, bacteria, and the like) is attached to a surface or how readily stain attached to a surface is removed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
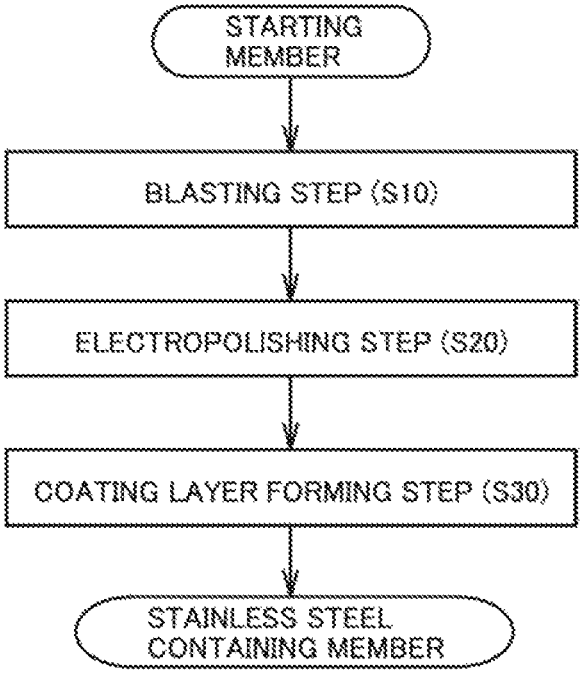
FIG. 1 is a flowchart showing an exemplary production method for a stainless steel containing member according to the present invention.

The following describes a production method for a stainless steel containing member and the stainless steel containing member according to the present invention in detail.

<Production Method for Stainless Steel Containing Member>

A production method for a stainless steel containing member according to the present invention includes the following steps:

a blasting step S10 of blasting a surface of a starting member, the surface being composed of stainless steel; and an electropolishing step S20 of electropolishing the surface having been blasted. The production method for the stainless steel containing member according to the present invention may further include a coating layer forming step S30 of forming a coating layer on the surface having been electropolished, coating layer forming step S30 being performed after electropolishing step S20.

(1) Blasting Step S10

This step is a step of blasting the surface of the starting member, the surface being composed of stainless steel. Accordingly, the surface is provided with a first uneven surface shape. According to the blasting, even when the starting member has a surface having a complicated shape, the starting member can be treated to have a uniform surface unevenness.

The starting member is not particularly limited as long as the surface (usually, the entire surface or most of the surface) thereof is composed of stainless steel. The starting member may be a member only composed of stainless steel, or may be a composite material of stainless steel and other material(s). Preferably, the starting member is a member only composed of stainless steel. The surface composed of stainless steel may be an intact surface having been through no particular surface treatment or having no coating layer formed thereon.

Examples of the stainless steel can include austenite-based stainless steel, ferrite-based stainless steel, martensite-based stainless steel, two-phase stainless steel, and precipitation hardening stainless steel. Specific examples of the austenite-based stainless steel include SUS301, 301L, 303, 304, 304L, 305, 310S, 312L, 316, 316L, and 317. Specific examples of the ferrite-based stainless steel include SUS405, 410L, 430, and 436L. Specific examples of the martensite-based stainless steel include SUS403 and 410. Specific examples of the two-phase stainless steel include SUS329J1 and SUS329J3L. Specific examples of the precipitation hardening stainless steel include SUS630 and 631. Particularly, the stainless steel preferably contains a relatively large amount of nickel because such stainless steel is unlikely to be damaged by an acidic component in an electropolishing solution and is likely to obtain luster after the electropolishing. Hence, the stainless steel is preferably a 300 series SUS such as the austenite-based stainless steel, or is a 600 series SUS such as the precipitation hardening stainless steel.

The starting member has a long side direction and a short side direction. The size of the starting member is not particularly limited, and the maximum length thereof can be, for example, about 0.5 to 5 m, and is preferably about 0.7 to 3 m. In order to effectively obtain an effect by the present invention, a ratio of the maximum length to the minimum length (maximum length/minimum length) is preferably not less than 1.5, is more preferably not less than 2, and is further preferably not less than 3 (for example, not less than 5). The "long side direction" means the direction of maximum length. Moreover, the "short side direction" means the direction of minimum length.

Although no specific shape of the starting member is particularly limited, an exemplary representative shape thereof is a shape of column having a long side direction. The starting member may be hollow (for example, hollow columnar body), and in this case, the starting member can be a pipe such as a stainless steel pipe. The pipe can have a circular cross sectional shape or a quadrangular cross sectional shape such as a rectangular cross sectional shape or a square cross sectional shape, for example. The starting member may have a shape having a curved shape portion or a bent portion. For example, the starting member may be a combined, member in which two or more members each having a surface composed of stainless steel are combined with each other. In this case, the starting member may have a welded portion on that surface, for example.

As a blasting apparatus used for the blasting, it is possible to use: an air blasting apparatus (blower type, compressor type or the like) ejecting media (abrasives) using air; a shot blasting apparatus ejecting media by rotational movement provided by a motor; or the like. Examples of the material of the media include alumina (brown, white), silicon carbide, glass, iron, copper, zinc, aluminum, stainless steel, silica sand, garnet, resin, and the like. The shape of each of the media is not particularly limited and is, for example, a spherical shape or substantially spherical shape. The particle size (diameter) of each of the media can be 5 μm to 2 mm, for example.

In view of the fingerprint concealing property and cleanability of the stainless steel containing member to be obtained, the blasting is preferably performed such that the resulting first uneven surface shape has an arithmetic mean roughness Ra, defined in JIS B 0601:2001, of not less than 1.5 μm, and the blasting is more preferably performed such that the resulting first uneven surface shape has an Ra of not less than 1.7 μm. For the same reason, the first uneven surface shape resulting from the blasting preferably has an Ra of not more than 6.0 μm and more preferably has an Ra of not more than 4.0 μm. Although it depends on a condition in electropolishing step S20, if Ra of the first uneven surface shape is too large, stain attached to the surface unevenness of the stainless steel containing member is unlikely to be removed, with the result that the cleanability tends to be decreased. On the other hand, if Ra of the first uneven surface shape is too small, the fingerprint concealing property is adversely affected. The surface roughness, such as arithmetic mean roughness Ra, can be measured using a laser microscope or a three-dimensional shape measuring device.

The surface roughness of the first uneven surface shape formed by the blasting can be controlled by adjusting the particle size, shape, material, ejection rate, or ejection density of the media.

The member having been blasted is then provided for electropolishing step S20 described later; however, the following steps may be provided before electropolishing step S20, for example.

[a] Degreasing Step. This is a treatment step for removing or reducing oil or the like attached to the surface and/or permeated from the surface. The degreasing step can be a treatment for immersing the member having been blasted into a degreaser. For the degreaser, a conventionally known degreaser can be used. The temperature of the degreasing treatment is, for example, 40 to 70° C., and is preferably 50 to 65° C.

[b] Acid Immersion Step. With this treatment, the degreaser attached to the member having been through the degreasing treatment can be removed or reduced. When water is attached to the surface of the member having been blasted and to be provided for electropolishing step S20, this water can be prevented from being mixed in an electropolishing solution used in electropolishing step S20 and accordingly diluting the electropolishing solution, by using, as the acid, at least one of components contained in the electropolishing solution.

[c] Water Washing Step and Dewatering Step. With a water washing treatment, stain attached to the member having been blasted, the degreaser, or the like can be removed or reduced. The water washing step can be a treatment of immersing the member having been blasted into water, a treatment of spraying water to the member, a combination thereof, or the like. In the case Where the member having been through the water washing step is to be subjected to electropolishing step S20, a dewatering step for removing water attached to the surface is preferably provided before electropolishing step S20 in order to prevent dilution of the electropolishing solution. The dewatering step can be a step of removing water by blowing air or the like.

(2) Electropolishing Step S20

Figure 2:
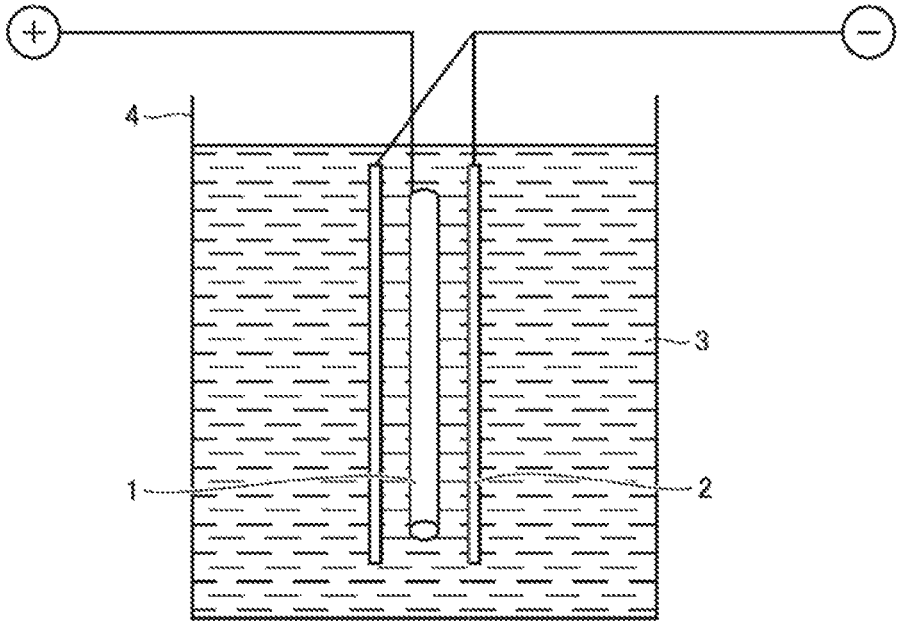
FIG. 2 is a schematic cross sectional view showing, an exemplary electropohshing step according to the present invention.

This step is a step of electropolishing the surface having been blasted. With reference to FIG. 2, the electropolishing can be performed in the following manner: member 1 having been blasted and an electrode 2 are immersed in an electropolishing solution 3 accommodated in an electropolishing bath 4, and direct current is applied between member 1 having been blasted (hereinafter, simply referred to as "member 1") which serves as an anode electrode (positive electrode) and electrode 2 serving as a cathode electrode (negative electrode). Member 1 can also be provided with the function as an anode electrode by preparing a different anode electrode immersed in electropolishing solution 3 and bringing member I into contact with this anode electrode. In the electropolishing, ionization reaction (metal dissolution reaction) of the metal constituting the stainless steel proceeds at the anode electrode (member 1) to cause generation of oxygen gas, whereas hydrogen gas is generated at the cathode electrode due to reduction of electropolishing solution 3.

With the electropolishing, projection portions of the first uneven surface shape are dissolved preferentially, with the result that the first uneven surface shape becomes obtuse to form a more smoothed second uneven surface shape. With this second uneven surface shape, the stainless steel containing member can exhibit excellent fingerprint concealing property and cleanability. Moreover, by performing the electropolishing, a passive state film, which is rich in Cr, is formed on the electropolished surface, thereby improving corrosion resistance. Moreover, by performing the electropolishing, oil or the like attached to the surface of the starting member or permeated from the surface to the inside can be also removed.

An electrolytic solution is used for electropolishing solution 3. Specific examples of electropolishing solution 3 (electrolytic solution) include a sulfuric acid based electrolytic solution (water solution), a phosphoric acid based, electrolytic solution (water solution), a perchloric acid based electrolytic solution (water solution), a sulfuric acid-phosphoric acid based electrolytic solution (water solution), and a sulfuric acid-phosphoric acid-phosphorous acid based electrolytic solution (water solution). Electropolishing solution 3 can include one or two or more types of additive agents such as a surfactant, for example. In order to secure uniform concentration of electropolishing solution 3 during the electropolishing, an agitation device such as an air agitator or propeller agitator is provided at electropolishing bath 4 and the electropolishing is preferably performed while agitating electropolishing solution 3. The temperature of electropolishing solution 3 during the electropolishing is, for example, 40 to 80° C. and is preferably 55 to 70° C. As the temperature of electropolishing solution 3 is higher, reaction rate of the electropolishing tends to be larger; however., it is preferable to employ the above-described temperature range in view of controllability of the second uneven surface shape and operation environment.

Preferably, electrode 2 (cathode electrode) is composed of a material that is unlikely to be damaged by electropolishing solution 3. Examples of such a material can include copper, stainless steel, titanium, lead, aluminum, graphite, and the like. Electrode 2 is placed to face member 1 subjected to the electropolishing and immersed in electropolishing solution 3. The electropolishing mainly proceeds at the outer surface of member 1 through which current is more likely to flow between member 1 and electrode 2. The current density in the electropolishing is, for example, 1 to 60 A/dm$^2$, and is preferably 5 to 30 A/dm$^2$.

As electrode 2, a plate-like electrode can be used, for example. In order to secure a distance between the surface of member 1 and electrode 2 as uniform as possible across the entire surface of member 1 and electropolish the entire surface of member 1 as uniform as possible, two or more electrodes 2 (for example, plate-like electrode plates) may be immersed in electropolishing solution 3, or two or more electrodes 2 (for example, plate-like electrode plates) may be immersed in electropolishing solution 3 and the member may be immersed between these electrodes 2 as shown in FIG. 2.

Moreover, in order to secure a distance between the surface of member 1 and electrode 2 as uniform as possible across the entire surface of member 1 and electropolish the entire surface of member 1 as uniform as possible, the shape of electrode 2 may be adjusted according to the shape of member 1. For example, in the case where member 1 has a cylindrical shape or the like as shown in FIG. 2, electrode 2 may have a curved surface portion in conformity with the curved surface portion of the surface of member 1. In the case where member 1 has a complicated shape, electrode 2 may have a shape in conformity with the complicated shape in order to secure a distance between the surface of member 1 and electrode 2 as uniform as possible across the entire surface of member 1.

In the case where electrode 2 is an electrode adjustable in position in electropolishing solution 3, an immersion position of electrode 2 can be appropriately changed according to the shape of member 1. This is advantageous when uniformly electropolishing the surface of member 1. Moreover, even in the case where two or more types of members 1 having different shapes are electropolished, the surfaces of these members can be uniformly electropolished. Electrode 2 adjustable in position is preferably capable of being moved in the horizontal direction, the vertical direction, or both.

In the present invention, member 1 is electropolished while immersed in electropolishing solution 3 with the long side direction thereof being inclined relative to the horizontal direction. Accordingly, there can be obtained a stainless steel containing member which is excellent in in-plane uniformity of the second uneven surface shape and which has uniform properties such as fingerprint concealing property, corrosion resistance, and cleanability in the plane of the surface. This is presumably due to the following reason. That is, in the electropolishing, oxygen gas is generated from the surface of member 1 as the reaction proceeds as described above. By immersing member 1 in electropolishing solution 3 with its long side direction being inclined relative to the horizontal direction, bubbles of the oxygen gas caused by the reaction are likely to leave from the surface of member 1, with the result that the reaction is unlikely to he inhibited by attachment of the bubbles on the surface (see FIG. 3). On the other hand, if member 1 is immersed with its long side direction being in parallel with the horizontal direction, bubbles of the oxygen gas stay at the bottom portion of the member to inhibit elution of metal ions, with the result that that portion is not effectively electropolished to cause variation in the uneven surface shape (see FIG. 4).

Figure 3:
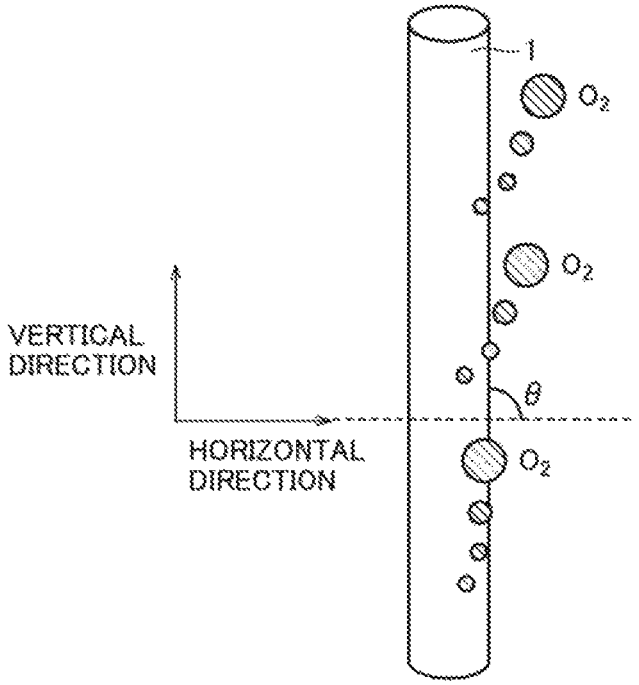
FIG. 3 is a schematic view showing that a member having been blasted is electropolished according to the present invention.
Figure 4:
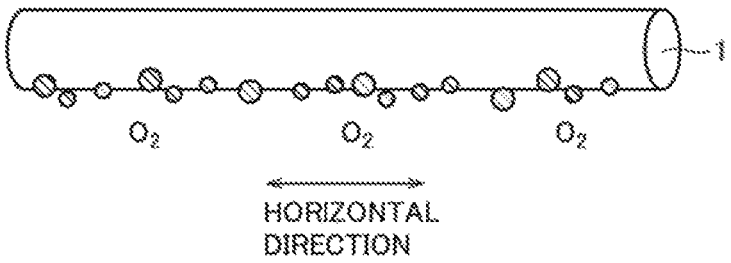
FIG. 4 is a schematic view showing that the member having been blasted is electropolished such that: the member having been blasted is immersed with the long side direction thereof being in parallel with the horizontal direction.

With reference to FIG. 3, in view of the in-plane uniformity of the second uneven surface shape to be obtained, an angle θ between the long side direction of member 1 and the horizontal direction is preferably 60 to 90°, is more preferably 70 to 90°, and is further preferably 80 to 90°. Particularly preferably, member 1 is immersed with its long side direction being in substantially parallel with the vertical direction. The expression "in substantially parallel with the vertical direction" means that angle θ is 85 to 90°. It should be noted that angle θ is 0° when member 1 is placed in parallel with the horizontal direction and is 90° when placed in parallel with the vertical direction, and the possible maximum value of angle θ is 90°. Angle θ is most preferably 90°.

As means for immersing member 1 in electropolishing solution 3 with its long side direction being inclined relative to the horizontal direction (desirably, with the long side direction being in substantially parallel with the vertical direction), there can be employed means for fixing the bottom surface of electropolishing bath 4 and the lower end portion of member 1 to each other, however, there is preferably employed means for fixing the upper end of member 1 and a supporting member to each other. This supporting member can be a member (in the form of a beam) provided, above electropolishing bath 4 and extending in the lateral direction, for example. By attaching member 1 to a fixture of the supporting member, member 1 can be immersed in electropolishing solution 3 with member 1 being hung therefrom. Preferably, member 1 is attachable to and detachable from the fixture. The supporting member may be capable of adjusting the position of the fixture. Moreover, the supporting member may have two or more fixtures. Accordingly, two or more members 1 can be electropolished simultaneously.

The manner of immersion (orientation of immersion) of member 1 into electropolishing solution 3 according to the present invention is advantageous in terms of the following points, for example.

[a] Electropolishing can be performed onto a member 1 having a large size without problem. According to the present invention, even when the size of member 1 is large, the electropolishing can be performed while suppressing increase of an area occupied by electropolishing bath 4 or without increasing the occupied area.

[b] According to the present invention, mass production is facilitated by, for example, treating a plurality of members at a time in one electropolishing bath 4. Moreover, member 1 is also facilitated to be immersed therein and taken out therefrom, which is also advantageous in terms of mass production.

[c] Even when member 1 is hollow, member 1 having been electropolished can be taken out from electropolishing solution 3 without taking electropolishing solution 3 in the hollow portion. Accordingly, electropolishing solution 3 can be suppressed from being wasted.

With [a] to [c] described above, the production of the stainless steel containing member is advantageous in terms of production efficiency, mass production, upsizing, industrialization, and economy.

In view of the fingerprint concealing property and cleanability of the stainless steel containing member to be obtained, the electropolishing is preferably performed such that the resulting second uneven surface shape has an arithmetic mean roughness Ra, defined in JIS B 0601:2001, of not less than 0.5 μm, and the electropolishing is more preferably performed such that the resulting second uneven surface shape has an Ra of not less than 1 μm (for example, not less than 2 μm). For the same reason, the second uneven surface shape after the electropolishing preferably has an Ra of not more than 5 μm and more preferably has an Ra of not more than 3.5 μm. If Ra of the second uneven surface shape is too large, stain attached to the surface unevenness of the stainless steel containing member is unlikely to be removed, with the result that the cleanability tends to be decreased. Moreover, if Ra of the second uneven surface shape is too small, the fingerprint concealing property is adversely affected.

in view of the fingerprint concealing property and cleanability of the stainless steel containing member to be obtained, a maximum valley depth Rv defined in JIS B 0601:2001 is preferably 5 to 40 μm, and is more preferably 10 to 30 μm. For the same reason, a ten-point mean roughness $Rz_{JIS}$ defined in JIS B 0601:2001 is preferably 2 to 20 μm and is more preferably 5 to 20 μm.

The surface roughness of the second uneven surface shape formed by the electropolishing can be controlled by adjusting type of electropolishing solution 3, temperature, electropolishing time, and current density.

The production method for the stainless steel containing member according to the present invention can include an additional step such as a step of removing electropolishing solution 3 attached to the surface of member 1 having been electropolished. The step of removing electropolishing solution 3 can be a treatment of immersing member 1 having been electropolished into water, a treatment of spraying water to member 1, or a combination thereof. Another example of the additional step is a step of immersing it into an acid such as sulfuric acid. By immersing member 1 having been electropolished into the acid, electropolishing solution 3 attached to the surface can be diluted and removed. Another example of the additional step is a step of wiping the surface of the stainless steel containing member using a cloth or the like.

(3) Coating Layer Forming Step S30

The stainless steel containing member obtained by electropolishing step S20 can be used suitably as a member for various purposes without modification; however, coating layer forming step S30 of forming a coating layer on the surface having been electropolished may be provided to form a coating layer on the second uneven surface shape.

The coating layer can be formed by coating with a desired coating material itself or a liquid (solution or the like) containing the desired coating material using a conventionally known method. In the case where the coating liquid contains a solvent, a drying step may be provided after the coating treatment as required. A step of hardening the coating layer by heat or light irradiation may be provided.

Specific examples of the coating layer includes a layer containing a rust prevention agent, and a layer containing a surfactant. These layers can contain a binder resin as required. As the coating layer, a layer constituted of a thermoplastic resin or a cured material of a curable resin may be provided. By forming the coating layer, the corrosion resistance and surface strength of the stainless steel containing member can be increased. By providing the coating layer containing a surfactant, surface discoloration can be prevented and rusting can be suppressed. In order to secure the fingerprint concealing property, the coating layer preferably has a light transmission property, and is more preferably optically transparent.

<Stainless Steel Containing Member>

The stainless steel containing member according to the present invention is obtained b the production method according to the present invention, and includes the above-described second uneven surface shape. The stainless steel containing member according to the present invention is excellent in in-plane uniformity of the second uneven surface shape included in the stainless steel containing member, and the second uneven surface shape can be constituted of a substantially uniform uneven surface shape.

With this second uneven surface shape, the stainless steel containing member according to the present invention can exhibit uniform or substantially uniform and excellent fingerprint concealing property, cleanability, and the like across the entire surface. Moreover, uniform or substantially uniform and excellent corrosion resistance can be exhibited across the entire surface. Furthermore, the stainless steel containing member according to the present invention is excellent also in terms of design due to the matte feeling resulting from the surface unevenness.

The stainless steel containing member according to the present invention can be used suitably as a stainless steel member that may be touched by a person's hand, or as an instrument or component required to have a hygienic appearance. Specific examples of the stainless steel member that may be touched by a person's hand include: a handrail; a parapet; a doorknob; various types of frames such as a window frame; a handgrip; an external cover for power supply or button; a railing; a fence; a handle; and daily necessaries (such as tableware) made of stainless steel. Specific examples of the instrument or component required to have a hygienic appearance include a medical instrument, and a component for medical device.

EXAMPLE

Hereinafter, the present invention will be described more in detail with reference to an example and a comparative example, but the present invention is not limited to these examples. In the example and comparative example described below, arithmetic mean roughness Ra, maximum valley depth Rv, and ten point means surface roughness $Rz_{JIS}$ of surface unevenness were in compliance with JIS B 0601:2001, and were measured using a "shape measuring laser microscope VK-8700" provided by KEYENCE CORP.

Example 1

A quadrangular pipe composed of SUS304 was prepared. This quadrangular pipe was a hollow stainless steel pipe having a rectangular cross section, and had a length (longitudinal length) of 39.5 cm, a width of 5 cm, and a thickness of 0.2 cm [maximum length (longitudinal length)/minimum length (thickness)=197.5].

Both the main surfaces of the quadrangular pipe were blasted using a compressor type air blasting apparatus and using spherical alumina as media. For the first uneven surface shape (one arbitrary point in one main surface) in the quadrangular pipe having had been blasted, an arithmetic mean roughness Ra was measured to be 1.96 μm, a maximum valley depth Rv was measured to be 19.32 μm, and a ten-point mean roughness $Rz_{JIS}$ was measured to be 16.24 μm. The term "main surface" refers to a surface constituted of sides in the longitudinal direction and sides in the width direction.

Next, electropolishing was performed by immersing it into an electropolishing solution constituted of an aqueous sulfuric acid-phosphoric acid based solution. While agitating the electropolishing solution, the electropolishing was performed under conditions that the temperature of the electropolishing solution was 60° C., current density was 8 A/dm$^2$ (applied voltage of 8V), and electropolishing time was 8 minutes. For a cathode electrode, two copper plates were used and they were placed to face each other and were immersed in the electropolishing solution. The quadrangular pipe was placed and immersed between two copper plates such that the main surfaces thereof faced the copper plates. During the electropolishing, the quadrangular pipe was immersed such that the long side direction (longitudinal direction) of the quadrangular pipe was in parallel with the vertical direction (θ=90°). In this way, a stainless steel containing member having surface unevenness was obtained. Arithmetic mean roughness Ra, maximum valley depth Rv and ten-point mean roughness $Rz_{JIS}$ of the second uneven surface shape in the stainless steel containing member (three points for each of the two main surfaces) were measured. The result is shown in Table 1. The two main surfaces are indicated as a first main surface and a second main surface in Table 1. The three points described above are a central portion, a vicinity of one end portion, and a vicinity of the other end portion in the length direction.

Comparative Example 1

A stainless steel containing member having surface unevenness was obtained under the same conditions as those of Example 1 except that the quadrangular pipe was immersed with the long side direction (longitudinal direction) thereof being in parallel with the horizontal direction (θ=0°) during the electropolishing. During the electropolishing, the quadrangular pipe was immersed with the first main surface facing upward and the second main surface facing downward. Arithmetic mean roughness Ra, maximum valley depth Rv, and ten-point mean roughness $Rz_{JIS}$ of the second uneven surface shape in the stainless steel containing member (three points for each of the two main surfaces) were measured. The result is shown in Table 1. It should be noted that in Comparative Example 1, arithmetic mean roughness Ra, maximum valley depth Rv, and ten-point mean roughness $Rz_{JIS}$ of the first uneven surface shape in the quadrangular pipe having had been blasted (one arbitrary point in one main surface) were measured and were comparable to those in Example 1. The three points are a central portion, a vicinity alone end portion, and a vicinity of the other end portion in the length direction.

TABLE 1

| | | Example 1 | | | Comparative Example 1 | | |
|---|---|---|---|---|---|---|---|
| Main Surface | Measurement Point | Ra (μm) | Rv (μm) | $Rz_{RS}$ (μm) | Ra (μm) | Rv (μm) | $Rz_{RS}$ (μm) |
| First Main Surface | No. 1 | 1.12 | 13.48 | 6.22 | 1.55 | 24.00 | 11.96 |
| | No. 2 | 1.02 | 11.16 | 5.87 | 1.59 | 18.73 | 11.97 |
| | No. 3 | 1.24 | 13.33 | 8.26 | 1.39 | 19.45 | 13.14 |
| Second Main Surface | No. 1 | 1.23 | 16.72 | 8.97 | 2.40 | 44.35 | 23.18 |
| | No. 2 | 1.48 | 13.83 | 7.78 | 2.25 | 27.25 | 17.16 |
| | No. 3 | 1.25 | 13.50 | 7.69 | 2.41 | 31.67 | 18.55 |

Although the present invention has been described and illustrated in detail, it is clearly understood that the same is by way of illustration and example only and is not to be taken by way of limitation, the scope of the present invention being interpreted by the terms of the appended claims.

What is claimed is:

1. A production method for a stainless steel containing member, comprising the steps of:

blasting a surface of a hollow starting member having a long side direction and a short side direction, a ratio of a length in the long side direction to a length in the short side direction being not less than 3 and the surface of the hollow starting member being composed of stainless steel; and electropolishing the surface of the hollow starting member having been blasted in an electropolishing step that is performed only once, in the step of electropolishing, the starting member being immersed in an electropolishing solution with the long side direction of the starting member being inclined relative to a horizontal direction, wherein in the step of electropolishing, a cathode electrode adjustable in position in the electropolishing solution is immersed in the electropolishing solution and the position of the cathode electrode is adjusted according to the shape of the hollow starting member, in the step of electropolishing, an upper end of the starting member is fixed to a fixture of the supporting member so that the starting member is immersed in the electropolishing solution with the starting member being hung from the supporting member, and the supporting member is provided above the electropolishing solution, and the supporting member is capable of adjusting a position of the fixture.

2. The production method according to claim 1, wherein in the step of electropolishing, the starting member is immersed in the electropolishing solution such that the long side direction of the starting member is substantially in parallel with a vertical direction.

3. The production method according to claim 1, further comprising the step of forming a coating layer on the surface having been electropolished after the step of electropolishing.

4. The production method according to claim 3, wherein the coating layer contains a rust prevention agent.

5. The production method according to claim 1, wherein the cathode electrode is adjustable in position in both horizontal and vertical directions.

6. The production method according to claim 1, wherein during the step of electropolishing, the position of the cathode electrode is adjusted in both horizontal and vertical directions.

* * * * *